United States Patent [19]

Calafut

[11] Patent Number: 5,036,561

[45] Date of Patent: Aug. 6, 1991

[54] COMBINED DEPILLER AND DELINTER

[76] Inventor: Edward J. Calafut, 2590 Glenwood Rd., Vestal, N.Y. 13850

[21] Appl. No.: 487,785

[22] Filed: Mar. 5, 1990

[51] Int. Cl.[5] ..... A47L 25/08

[52] U.S. Cl. ..... 15/105; 15/104 A

[58] Field of Search ..... 51/181 R; 7/170; 15/105, 104.2, 104 A

[56] References Cited

U.S. PATENT DOCUMENTS

| | | | |
|---|---|---|---|
| 1,822,725 | 9/1931 | Cooper et al. | 15/105 |
| 3,330,077 | 7/1967 | Kanbar et al. | 15/104 A |
| 3,471,977 | 10/1969 | Roth | 15/105 |
| 3,638,270 | 2/1972 | Schlegel, Jr. et al. | 15/209 C |
| 4,142,334 | 3/1979 | Kirsch et al. | 15/104.93 |
| 4,639,963 | 2/1987 | Suzuki | 15/104 A |
| 4,686,731 | 8/1987 | Suzuki | 15/105 |
| 4,687,095 | 8/1987 | Iwasaki | 15/105 |

FOREIGN PATENT DOCUMENTS

| | | | |
|---|---|---|---|
| 999111 | 2/1976 | Canada | 15/105 |
| 1266268 | 10/1989 | Japan | 15/104 A |
| 332759 | 9/1958 | Switzerland | 15/104 A |
| 506559 | 5/1939 | United Kingdom | 15/105 |

*Primary Examiner*—Paul T. Sewell
*Assistant Examiner*—M. Denise Patterson
*Attorney, Agent, or Firm*—Kenneth P. Johnson

[57] ABSTRACT

Device for removing fiber pills and lint from a fabric in which a supporting substrate has affixed on one surface an abrasive coating of substantially uniform particles lying in the range of 280–600 grit size for removing pills and on another surface a fabric with a slant, hook or loop pile to remove lint. The device can be a pliant foam sheet with abrasive-coated film and fabric pile on opposite surfaces or a heavier brushlike implement having those two surfaces.

6 Claims, 1 Drawing Sheet

COMBINED DEPILLER AND DELINTER

FIELD OF THE INVENTION

This invention relates generally to devices for removal of fiber pills and lint from fabrics and, ore particularly, to a hand-held device providing a choice of surface characteristics for removing either the pills or lint.

BACKGROUND OF THE INVENTION

Textiles composed of soft-spun yarns tend to 10 form pills or balls of fibers on their surfaces with use because of the many loose fiber ends. The pills are unsightly and difficult to remove by brushing or with adhesive rollers. Usually the pills are individually picked off or carefully severed from the fabric 15 surface. Brushes having a variety of bristle stiffness and angles tend to be ineffective for clearing the surfaces of the pills, while effective for dust, lint or individual fiber removal.

Various implements have been devised for fiber pill removal but these are single purpose, relatively bulky, inflexible, or inconvenient for pocket or purse. Several are shown in U.S. Pat. No(s). 4,687,095; 4,686,731; 3,471,977 and 2,934,810. These devices typically comprise a mechanically interlocked assembly of several components and have a size equivalent to a small hair brush. Their working surfaces are frequently composed of loop pile, simple mesh fabric or mesh fabric specially coated with a coarse grit, usually 120 grit size or larger, that is too sharp and aggressive, being likely to damage a garment. Although of substantial size, these are relatively ineffective. As another alternative, some people employ safety razors effectively for pill removal, but at high risk of damage, since the fabric may be easily cut. In addition, blades, hooks or sharp implements may catch and pull "strings."

OBJECTS AND SUMMARY OF THE INVENTION

It is accordingly a primary object of this invention to provide a hand-held implement for removing fiber pills and lint from fabrics and clothing that has improved clearing ability and safety, less likelihood of fabric damage, and greater convenience for use and storage.

It is a further object of this invention to provide a depilling and delinting tool that is thin, flexible, accommodatingly shaped for improved accessibility and use that can be carried easily and unobtrusively in a purse or pocket for ready service.

The foregoing objects are attained in accordance with the invention by providing abrasive surface means for removing fabric pills and pile surface means for removing lint, both affixed on respective and opposite major surfaces of supporting substrate means. The two surface means and substrate means, in a preferred embodiment, form a hand-held pad assembly that is flexible, resilient, thin and of substantially planar shape, thus offering a choice of surface for the function required. The periphery of the assembly is a combination of straight and curved edges that promote accessibility and easy manipulation during use. The surface means can alternatively be secured on a thicker substrate, such as brush base for household use.

By combining thin, small grit abrasive and pile materials on opposite sides of a foam substrate or core, the resultant assembly becomes an effective, continuously available, cleaning implement that can be conveniently and inconspicuously stored in a purse or garment pocket without annoying bulk. The finer abrasive surface produces cleaner and neater pill removal because of smaller cutting edges on the grit particles. The flexibility of the assembly allows it to conform readily to any irregular surface or undulation to which it is applied and the combined arcuate and straight edges permit access to niches among garment buttons and pocket edges and trim.

The foregoing and other objects, features and advantages of the invention will become apparent from the following, more particular description of preferred embodiments of the invention with reference to the accompanying drawing.

DESCRIPTION OF THE PREFERRED EMBODIMENT

Figure 1:
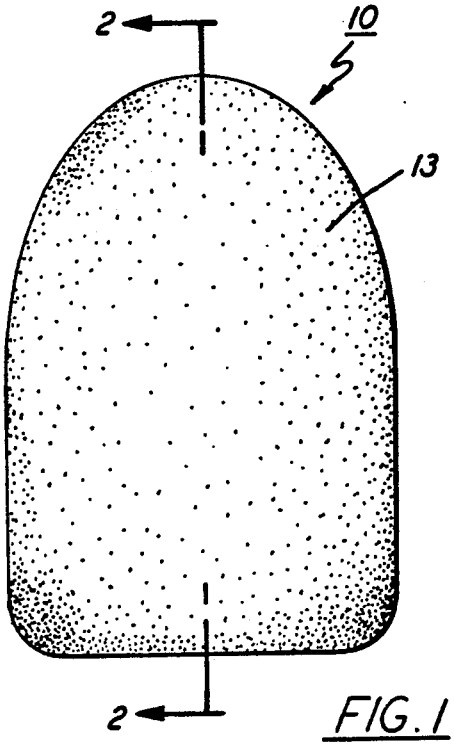
FIG. 1 is a plan view of a fabric pill and lint removing device constructed in accordance with the principles of the invention.
Figure 2:
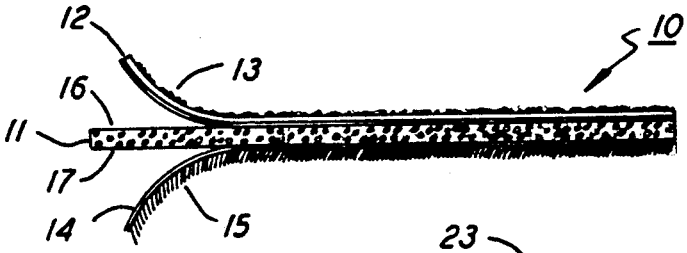
FIG. 2 is a sectional view of the fabric pill and lint removing device shown in FIG. 1 taken along the line 2—2 but with the outer layers of the device partially lifted from their substrate.

Referring to FIGS. 1 and 2, the device 10 for removing pills and lint from fabrics comprises generally a thin substrate 11 to which a pill removing layer 12 of cloth, film or paper-backing carrying an abrasive surface 13 and a lint removing layer 14 of pile fabric 15 are each adhesively attached on opposite substrate surfaces 16, 17. Substrate 11 is preferably formed of closed cell polymeric foam, such as polyethylene, having a thickness of one-sixteenth to one-eighth inch (0.1632–0.32 cm) but that may range from one-thirty second to one quarter inch (0.08–0.64 cm). Substrate 11 has the peripheral configuration shown in FIG. 1 and forms a cushioned, flexible, resilient base for the abrasive and pile layers. A favored pill removing layer 12 is a cloth-backed, commercially available, sheet material having adhered thereto by organic glue or resin a surface 13 of partially embedded abrasive particles of substantially uniform size, preferably of aluminum oxide that are within the range of 280 to 600 grit size. The abrasive surface may thus be graded minerals of 280 or 300 or 360, etc. in grit size. The backing 12 of the abrasive material 13 can be any material of suitable flexibility, such as paper, fiber, vinyl or other film backing, to which the abrasive particles can be secured. The combined backing 12, abrasive particles 13 and embedment are preferably processed to achieve a thickness that is relatively uniform without peaks and valleys in the nominal abrasive surface level.

Figure 3:
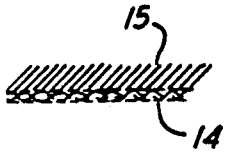
FIGS. 3 and 4 are cross sectional views of examples of lint removing fabrics suitable for use with the invention.
Figure 4:
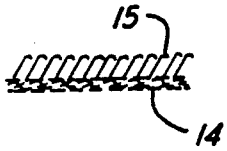

Lint removing layer 14 is a pile fabric that possesses lint retention quality and can be a fabric having cut pile 15 with a slant weave, such as cotton-backed nylon. Other fabrics having pile of hook fibers are also acceptable. Enlarged cross sectional views of slant and hook pile are shown respectively in FIGS. 3 and 4. The pile of these materials has free ends disposed in a common angular direction and demonstrates excellent gripping and holding ability for lint when drawn in one direction over a fabric to be cleared and then readily releases the captured and accumulated lint when drawn in a different, usually opposite direction.

The depilling and delinting device is inexpensively constructed by coating a relatively large sheet of substrate 11 with a suitable waterproof adhesive and attaching similarly sized sheets of pill-removing layer 12 with abrasive material 13 and pile layer 14 on the opposite surfaces 16 and 17, then die cutting a plurality of the completed devices from the laminated sheets. Adhesives of the pressure sensitive, heat activated or solvent activated types are acceptable.

Device 10 preferably is cut in the personal-size pad configuration shown in FIG. 1 to provide a variety of curved and straight edges in both dimension and location for enabling access to restricted or confined areas on clothing such as in the proximity of buttons, seams and trim. The thickness, resiliency and flexibility of the thin foam substrate cooperate to provide an unusually convenient, unobtrusive pocket or purse-sized implement that is uncommonly effective in easily removing pills and lint from fabrics of natural or synthetic fibers without damage. Pills, in particular, are readily removed from garments that previously were subjected to time consuming hand picking or shaving. The abrasive grit size of 280–600 is finer than that heretofore recommended for pill removal and has been found to exhibit unexpected beneficial effectiveness for both natural and synthetic materials, especially on soft polyester and wool fabrics. Known devices typically recommend open mesh fabrics having adhered thereto coarse 120 grit. Because of the finer grit size of 280–600, the depilling surface is helpful in lifting matted fibers of suede or raising fibers in worn regions on suede.

Figure 5:
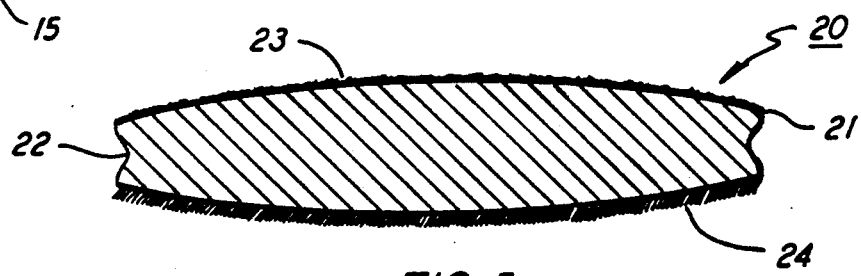
FIG. 5 is a sectional view of an alternative embodiment of a fabric pill and lint removing device.
Figure 6:
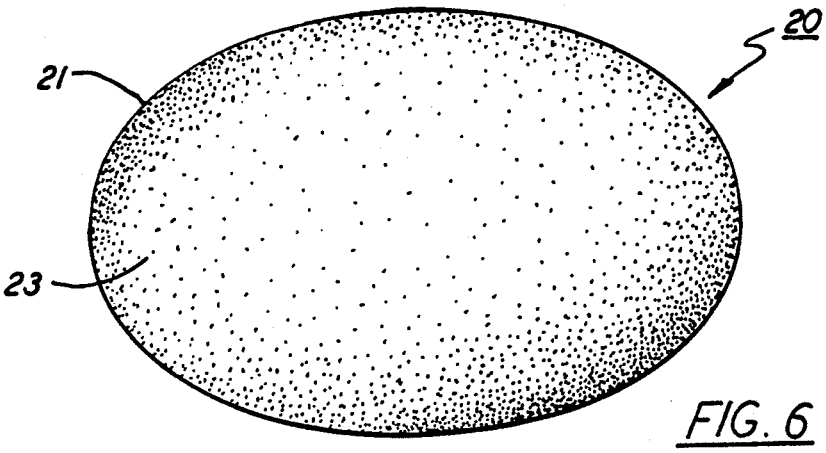
FIG. 6 is a plan view of the embodiment shown in FIG. 5.

The invention can also be constructed in another configuration that has an approximate ellipsoidal form similar to that of a hand brush, as seen in FIGS. 5 and 6. In this form, the depiller and delinter 20 provides an easily gripped and substantially unyielding implement 20 having major surfaces that lend themselves to clearing large areas of a garment with efficiency and reliability. In FIGS. 5 and 6 a substrate 21, a molded plastic or shaped natural material, such as wood, is formed in an oval soap-cake configuration having peripheral recess 22 to facilitate gripping. A layer 23 of film-backed abrasive material is adhesively secured on one major surface and a fabric 24 of cut slant or hook pile filaments is adhesively secured on the opposite major surface.

In order to provide ability to abrasive surface 23 to conform to clothing surface irregularities during use, a layer of polymeric foam of thickness one-eighth to one-quarter inch (0.32–0.64 cm) can be adhesively secured to one major surface of elipsoid 21 and the abrasive layer 23, in turn, secured to the foam.

It will be noted that modification can be made in the configuration of the disclosed embodiments while retaining the inventive function of the depilling and delinting device. The device can be a combination of different edge shapes and the flexible substrate can be, for example, a matted fabric such as felt or other material that permits compression and flexibility and resilience. In the ellipsoid embodiment of FIGS. 5 and 6 a handle can be added, if desired. Various other lint removing fabrics such as loop pile can also be used.

While the invention has been particularly shown and described with reference to preferred embodiments thereof, it will be understood by those skilled in the art that changes in form and details may be made therein without departing from the spirit and scope of the invention.

What is claimed is:

1. A device for removing pills and lint from a fabric comprising:

planar substrate means formed of closed cell compressible polymeric foam having a nominal thickness lying between one thirty second and one quarter of an inch and having a pair of opposite, uninterrupted major surfaces;

a consistent, continuous, abrasive coating on one of said major surfaces co-extensive therewith having a backing layer to which is adhered partially embedded particles of substantially uniform size lying in the range of grit sizes between 250 and 600;

pile fabric means on the other of said major surfaces co-extensive therewith having a plurality of secured fibers of uniform density over said surface with their free ends extending in substantially common direction and length from a backing material secured to said other surface and disposed to catch lint when drawn across a fabric in a first direction and release said lint when so drawn in another direction.

2. The device as described in claim 1 wherein said abrasive coating means is a backing sheet having abrasive particles of aluminum oxide adhered thereto.

3. The device as described in claim 1 wherein the pile of said pile fabric means comprises a slant weave of polymeric filaments.

4. The device as described in claim 1 wherein the pile of said pile fabric means comprises hook filaments of polymeric material extending from said backing material.

5. The device as described in claim 1 wherein the pile of said pile fabric means comprises loop filaments of polymeric material extending from said backing material.

6. The device as described in claim 1 wherein said substrate means includes a peripheral portion in the form of a semicircle.

* * * * *